US006382926B2

(12) United States Patent
Ota et al.

(10) Patent No.: US 6,382,926 B2
(45) Date of Patent: May 7, 2002

(54) CONTROL VALVE IN VARIABLE DISPLACEMENT COMPRESSOR

(75) Inventors: Masaki Ota; Kazuya Kimura; Masahiro Kawaguchi; Ken Suitou, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/725,537

(22) Filed: Nov. 29, 2000

(30) Foreign Application Priority Data

Nov. 30, 1999 (JP) ..... 11-340401
Mar. 17, 2000 (JP) ..... 2000-075538

(51) Int. Cl.[7] ..... F04B 1/26
(52) U.S. Cl. ..... 417/222.2
(58) Field of Search ..... 417/222.2

(56) References Cited

U.S. PATENT DOCUMENTS 5,964,578 A * 10/1999 Suitou et al. ..... 417/222.2
6,146,106 A * 11/2000 Suitou et al. ..... 417/222.2
6,048,178 A1 * 5/2001 Ota et al. ..... 417/222.2

FOREIGN PATENT DOCUMENTS

JP 11-324930 11/1999

* cited by examiner

*Primary Examiner*—Charles G. Freay
*Assistant Examiner*—Michael K. Gray
(74) *Attorney, Agent, or Firm*—Morgan & Finnegan, LLP

(57) ABSTRACT

A control valve for a variable displacement compressor in refrigerant circuit permits the compressor displacement to be accurately controlled regardless of the thermal load on an evaporator. The refrigerant circuit includes a high pressure pipe, which extends between a discharge chamber of the compressor and a condenser. A first pressure monitoring point is located in the discharge chamber. A second pressure monitoring point is located in the high pressure pipe. A supply passage connects the second pressure monitoring point with a crank chamber of the compressor. The control valve is located in the supply passage and adjusts the opening size of the supply passage in accordance with the difference between the pressure at the first pressure monitoring point and the pressure at the second pressure monitoring point. The control valve includes a solenoid for determining the target value of the pressure difference. The control valve operates to maintain the determined target value.

19 Claims, 10 Drawing Sheets

CONTROL VALVE IN VARIABLE DISPLACEMENT COMPRESSOR

BACKGROUND OF THE INVENTION

The present invention relates to a control Valve used in a variable displacement compressor. More particularly, the present invention pertains to a control valve that controls the compressor displacement by adjusting the pressure in a crank chamber.

A typical refrigerant circuit of a vehicle air conditioner includes a condenser, an expansion valve, an evaporator and a compressor. The compressor receives refrigerant gas from the evaporator. The compressor then compresses the gas and discharges the gas to the condenser. The evaporator transfers heat to the refrigerant in the refrigerant circuit from the air in the passenger compartment. The pressure of refrigerant gas at the outlet of the evaporator, in other words, the pressure of refrigerant gas that is drawn into the compressor (suction pressure Ps), represents the thermal load on the refrigerant circuit.

Variable displacement swash plate type compressors are widely used in vehicles. Such compressors include a displacement control valve that operates to maintain the suction pressure Ps at a predetermined target level (target suction pressure). The control valve changes the inclination angle of the swash plate in accordance with the suction pressure Ps for controlling the displacement of the compressor. The control valve includes a valve body and a pressure sensing member such as a bellows or a diaphragm. The pressure sensing member moves the valve body in accordance with the suction pressure Ps, which adjusts the pressure in a crank chamber. The inclination of the swash plate is adjusted, accordingly.

In addition to the above structure, some control valves include an electromagnetic actuator, such as a solenoid, to change the target suction pressure. An electromagnetic actuator urges a pressure sensing member or a valve body in one direction by a force that corresponds to the value of an externally supplied current. The magnitude of the force determines the target suction pressure. Varying the target suction pressure permits the air conditioning to be finely controlled.

Such compressors are usually driven by vehicle engines. Among the auxiliary devices of a vehicle, the compressor consumes the most engine power and is therefore a great load on the engine. When the load on the engine is great, for example, when the vehicle is accelerating or moving uphill, all available engine power needs to be used for moving the vehicle. Under such conditions, to reduce the engine load, the compressor displacement is minimized. This will be referred to as a displacement limiting control procedure. A compressor having a control valve that changes a target suction pressure raises the target suction pressure when executing the displacement limiting control procedure. Then, the compressor displacement is decreased such that the actual suction pressure Ps is increased to approach the target suction pressure.

The graph of FIG. 11 illustrates the relationship between suction pressure Ps and displacement Vc of a compressor. The relationship is represented by multiple lines in accordance with the thermal load in an evaporator. Thus, if the suction pressure Ps is constant, the compressor displacement Vc increases as the thermal load increases. If a level Ps1 is set as a target suction pressure, the actual displacement Vc varies in a certain range (ΔVc in FIG. 11) due to the thermal load. If a high thermal load is applied to the evaporator during the displacement limiting control procedure, an increase of the target suction pressure does not lower the compressor displacement Vc to a level that sufficiently reduces the engine load.

Thus, the compressor displacement is not always controlled as desired as long as the displacement is controlled based on the suction pressure Ps.

SUMMARY OF THE INVENTION

Accordingly, it is an objective of the present invention to provide a control valve used in a variable displacement compressor that accurately controls the compressor displacement regardless of the thermal load on an evaporator.

To achieve the above objective, the present invention provides a control valve for a variable displacement compressor used in a refrigerant circuit. The refrigerant circuit includes a condenser and a high pressure passage extending from a discharge chamber of the compressor to the condenser. A section of the refrigerant circuit that includes the discharge chamber, the condenser and the high pressure passage forms a high pressure zone. The control valve controls the pressure in a crank chamber of the compressor to change the displacement of the compressor. The control valve includes a valve housing. The valve housing is located in a supply passage, which connects the high pressure zone to the crank chamber, The supply passage includes an upstream section, which is between the high pressure zone and the valve housing, and a downstream section, which is between the valve housing and the crank chamber. A first pressure chamber is defined in the valve housing. The first pressure chamber is exposed to the pressure of a first pressure monitoring point, which is located in the high pressure zone. A second pressure chamber is defined in the valve housing. The second pressure chamber is exposed to the pressure of a second pressure monitoring point, which is located in a part of the high pressure zone that is downstream of the first pressure monitoring point. The upstream section of the supply passage connects the first pressure chamber or the second pressure chamber to the corresponding pressure monitoring point. A valve body is located in the valve housing. The valve body adjusts the opening size of the supply passage. A pressure receiving body is located in the valve housing. The pressure receiving body moves the valve body in accordance with the difference between the pressure in the first pressure chamber and the pressure in the second pressure chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
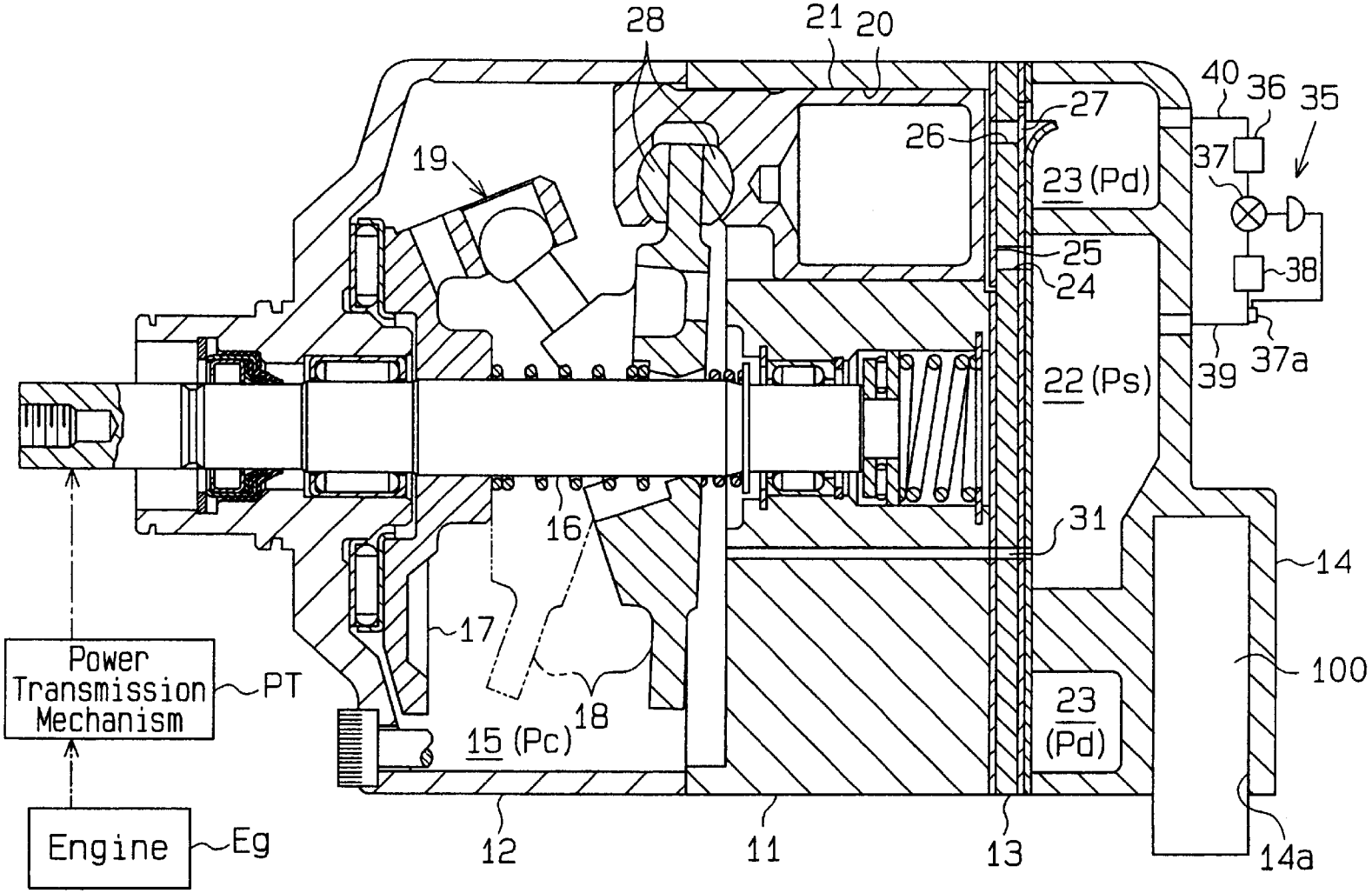
FIG. 1 is a cross-sectional view illustrating a variable displacement swash plate type compressor according to a first embodiment of the present invention.

A first embodiment of the present invention will now be described with reference to FIGS. 1 to 7. As shown in FIG. 1, a variable displacement swash plate type compressor used in a vehicle includes a cylinder block 11, a front housing member 12, which is secured to the front end face of the cylinder block 11, and a rear housing member 14, which is secured to the rear end face of the cylinder block 11. A valve plate assembly 13 is located between the cylinder block 11 and the rear housing member 14. In FIG. 1, the left end of the compressor is defined as the front end, and the right end of the compressor is defined as the rear end.

A crank chamber 15 is defined between the cylinder block 11 and the front housing member 12. A drive shaft 16 extends through the crank chamber 15 and is supported by the cylinder block 11 and a front housing member 12.

The front end of the drive shaft 16 is connected to an external drive source, which is an engine Eg in this embodiment, through a power transmission mechanism PT. The power transmission mechanism PT includes a belt and a pulley. The mechanism PT may be a clutch mechanism, such as an electromagnetic clutch, which is electrically controlled from the outside. In this embodiment, the mechanism PT has no clutch mechanism. Thus, when the engine Eg is running, the compressor is driven continuously.

A lug plate 17 is secured to the drive shaft 16 in the crank chamber 15. A drive plate, which is a swash plate 18 in this embodiment, is accommodated in the crank chamber 15. The swash plate 18 has a hole formed in the center. The drive shaft 16 extends through the hole in the swash plate 18. The swash plate 18 is coupled to the lug plate 17 by a hinge mechanism 19. The hinge mechanism 19 permits the swash plate 18 to rotate integrally with the lug plate 17 and drive shaft 16. The hinge mechanism 19 also permits the swash plate 18 to slide along the drive shaft 16 and to tilt with respect to a plane perpendicular to the axis of the drive shaft 16.

Several cylinder bores 20 (only one shown) are formed about the axis of the drive shaft 16 in the cylinder block 11. A single headed piston 21 is accommodated in each cylinder bore 20. Each piston 21 and the corresponding cylinder bore 20 define a compression chamber. Each piston 21 is coupled to the swash plate 18 by a pair of shoes 28. The swash plate 18 coverts rotation of the drive shaft 16 into reciprocation of each piston 21.

A suction chamber 22 and a discharge chamber 23 are defined between the valve plate assembly 13 and the rear housing member 14. The suction chamber 22 forms a suction pressure zone, the pressure of which is a suction pressure Ps. The discharge chamber 23 forms a discharge pressure zone, the pressure of which is a discharge pressure Pd. The valve plate assembly 13 has suction ports 24, suction valve flaps 25, discharge ports 26 and discharge valve flaps 27. Each set of the suction port 24, the suction valve flap 25, the discharge port 26 and the discharge valve flap 27 corresponds to one of the cylinder bores 20. When each piston 21 moves from the top dead center position to the bottom dead center position, refrigerant gas in the suction chamber 22 flows into the corresponding cylinder bore 20 via the corresponding suction port 24 and suction valve 25. When each piston 21 moves from the bottom dead center position to the top dead center position, refrigerant gas in the corresponding cylinder bore 20 is compressed to a predetermined pressure and is discharged to the discharge chamber 23 via the corresponding discharge port 26 and discharge valve 27.

The inclination angle of the swash plate 18 is determined according to the pressure in the crank chamber 15 (crank pressure Pc). The inclination angle of the swash plate 18 defines the stroke of each piston 21 and the displacement of the compressor.

Figure 2:
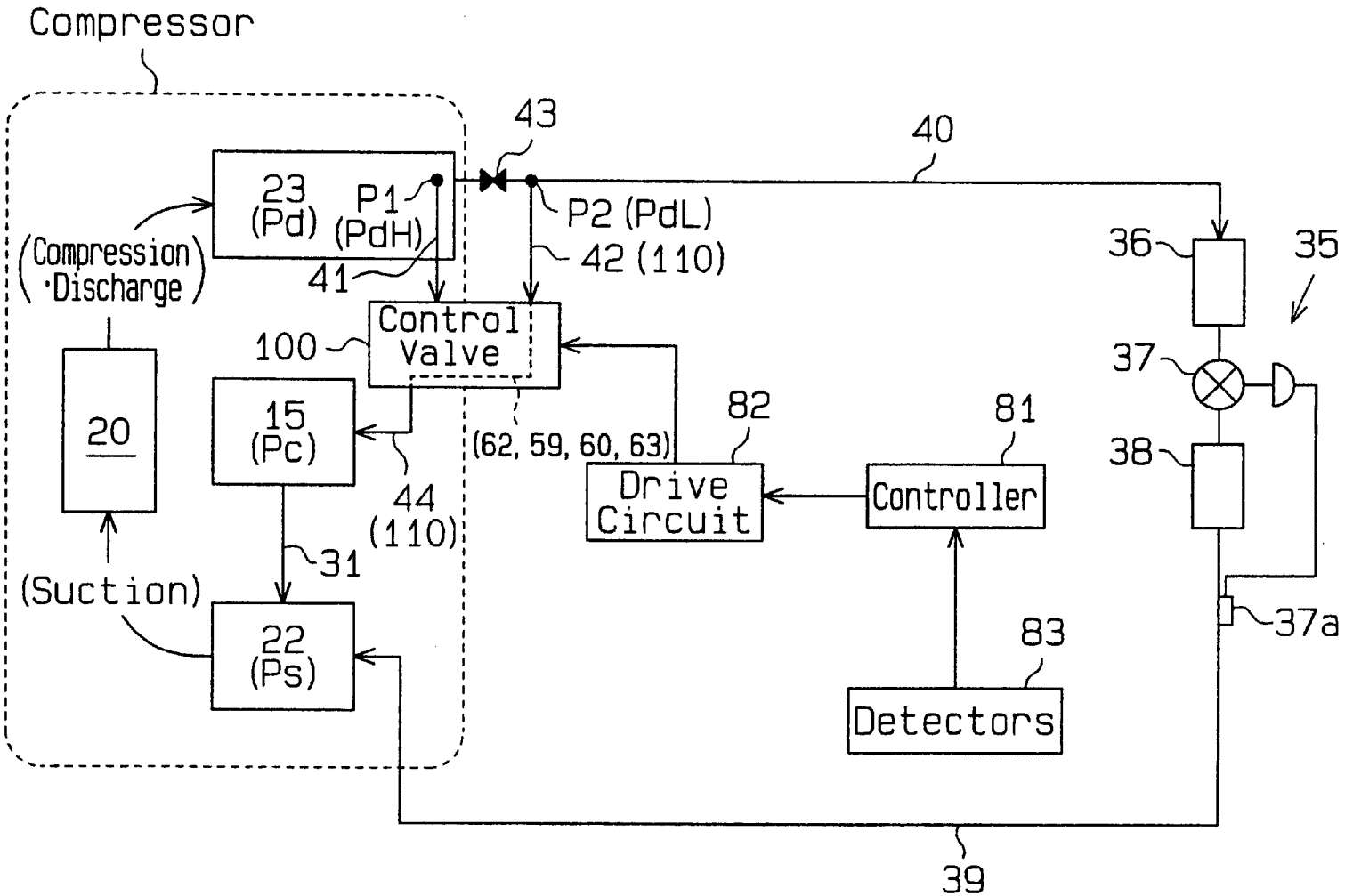
FIG. 2 is a schematic diagram illustrating a refrigerant circuit including the compressor of FIG. 1.

As shown in FIGS. 1 and 2, the refrigerant circuit of the vehicle air conditioner includes the compressor and an external circuit 35, which is connected to the compressor. The external circuit 35 includes a condenser 36, a temperature-type expansion valve 37 and an evaporator 38. The expansion valve 37 adjusts the flow rate of refrigerant supplied to the evaporator 38 based on the temperature or the pressure detected by a heat sensitive tube 37*a,* which is located downstream of the evaporator 38. The temperature or the pressure at the downstream of the evaporator 38 represents the thermal load on the evaporator 38. The external circuit 35 includes a low pressure pipe 39, which extends from the evaporator 38 to the suction chamber 22 of the compressor, and a high pressure pipe 40, which extends from the discharge chamber 23 of the compressor to the condenser 36.

The flow rate of the refrigerant in the refrigerant circuit is expressed by the product of the amount of the refrigerant gas discharged from the compressor during one rotation of the drive shaft 16 multiplied by the rotational speed of the drive shaft 16. Under the condition where the engine Eg rotates at a constant rotational speed, the flow rate of the refrigerant in the refrigerant circuit increases as the compressor displacement increases when the inclination angle of the swash plate 18 increases. In other words, when the inclination angle of the swash plate 18 or the compressor displacement is constant, the flow rate of the refrigerant in the refrigerant circuit increases as the rotational speed of the engine Eg increases.

Pressure loss in the refrigerant circuit increases as the flow rate of the refrigerant in the refrigerant circuit increases. If an upstream first pressure monitoring point and a downstream second pressure monitoring point are set up in the refrigerant circuit, the pressure difference between these two points due to the pressure loss shows a positive correlation with the flow rate of the refrigerant in the refrigerant circuit. Thus, the flow rate of the refrigerant in the refrigerant circuit can be detected indirectly by detecting the difference between the refrigerant gas pressure at the first pressure monitoring point and that at the second pressure monitoring point. In this embodiment, a first pressure monitoring point P1 is set up in the discharge chamber 23 corresponding to the most upstream section in the high pressure pipe 40, and a second pressure monitoring point P2 is set up in the high pressure pipe 40 at a predetermined distance downstream from the first point P1, as shown in FIG. 2. The refrigerant gas pressure at the first pressure monitoring point P1 and that at the second pressure monitoring point P2 are hereinafter referred to as PdH and PdL, respectively.

The compressor has a crank pressure control mechanism for controlling the crank pressure Pc. As shown in FIGS. 1 and 2, the crank pressure control mechanism includes a bleed passage 31, a first pressure introduction passage 41, a second pressure introduction passage 42, a crank passage 44 and a control valve 100. The bleed passage 31 connects the crank chamber 15 to the suction chamber 22 to conduct refrigerant gas from the crank chamber 15 to the suction chamber 22. The first pressure introduction passage 41 connects the discharge chamber 23, i.e., the first pressure monitoring point P1, to the control valve 100. The second pressure introduction passage 42 connects the second pressure monitoring point P2 to the control valve 100. The crank passage 44 connects the control valve 100 to the crank chamber 15.

The second pressure introduction passage 42 and the crank passage 44 form a supply passage 110 for connecting the second pressure monitoring point P2 to the crank chamber 15. The second pressure introduction passage 42 forms an upstream section of the supply passage 110, and the crank passage 44 forms a downstream section of the supply passage 110. The control valve 100 adjusts the flow rate of the high pressure refrigerant gas supplied from the second pressure monitoring point P2, through the supply passage 110, to the crank chamber 15 to control the crank pressure Pc.

As shown in FIG. 2, the high pressure pipe 40 is provided with a fixed restrictor 43 between the first pressure monitoring point P1 and the second pressure monitoring point P2. The fixed restrictor 43 increases the pressure difference (PdH−PdL) between the two pressure monitoring points P1 and P2. This enables the distance between the two pressure monitoring points P1 and P2 to be reduced and permits the second pressure monitoring point P2 to be relatively close to the compressor. Thus, the second pressure introduction passage 42, which extends from the second pressure monitoring point P2 to the control valve 100 in the compressor, can be shortened.

Figure 3:
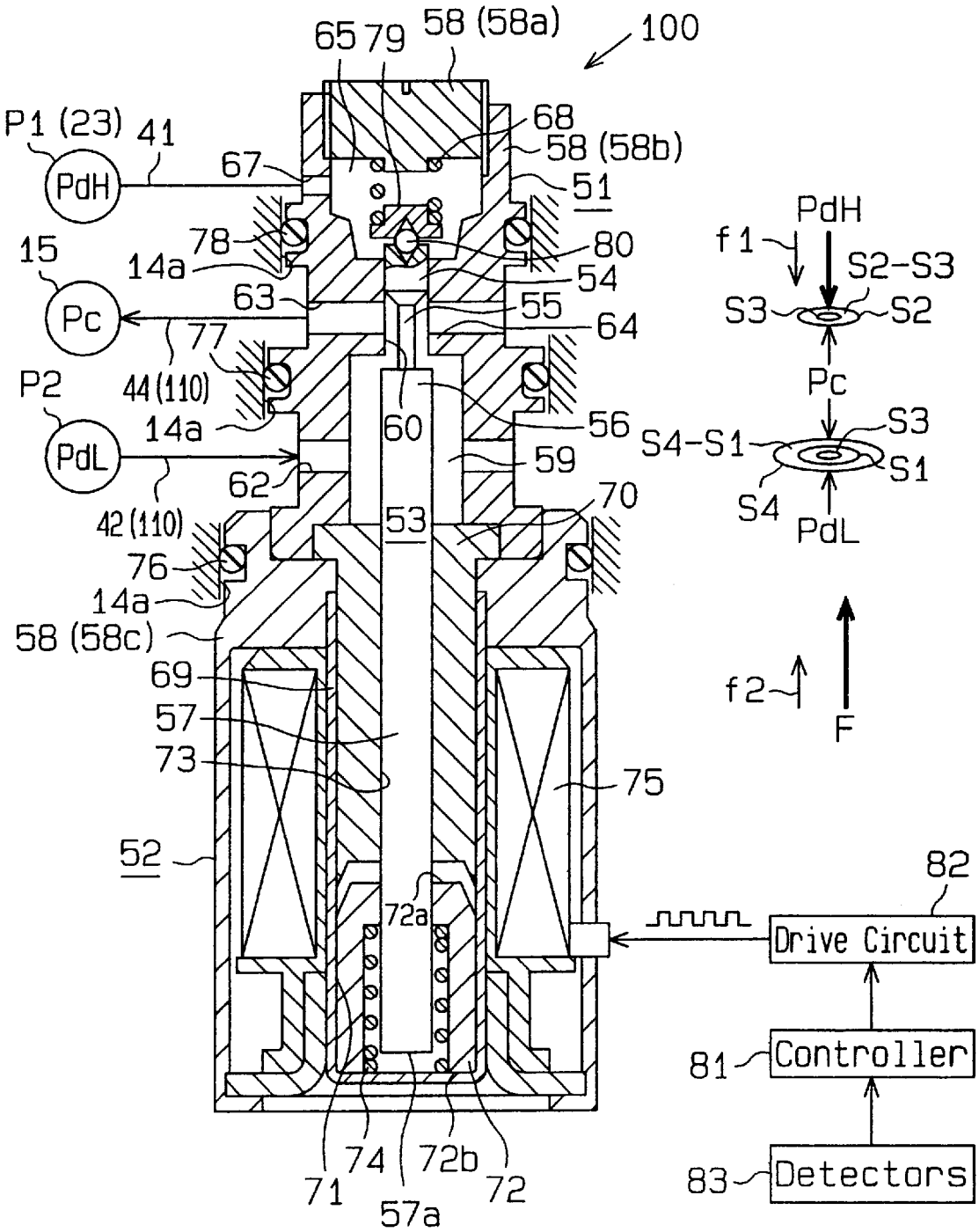
FIG. 3 is a cross-sectional view illustrating a control valve of FIG. 1.
Figure 4:
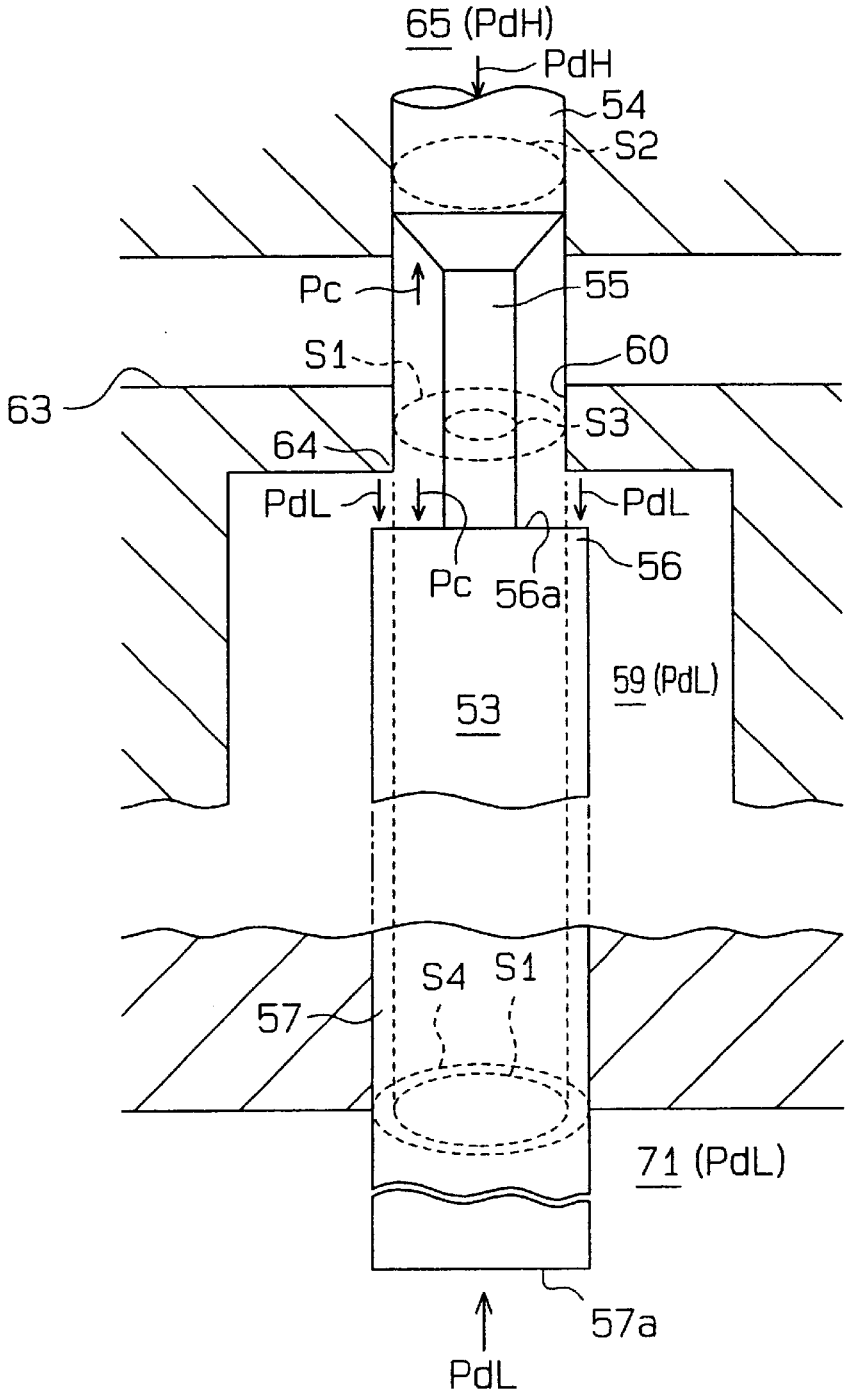
FIG. 4 is a schematic cross-sectional view showing part of the control valve shown in FIG. 3.

As shown in FIG. 1, the control valve 100 is fitted in a receiving hole 14*a* of the rear housing member 14. As shown in FIGS. 3 and 4, the control valve 100 is provided with an inlet valve mechanism 51 and a solenoid 52, which serves as an electromagnetic actuator. The inlet valve mechanism 51 adjusts the aperture of the supply passage 110. The solenoid 52 exerts a force according to the level of the electric current supplied from the outside to the inlet valve mechanism 51 through an operating rod 53. The operating rod 53 is cylindrical and has a divider 54, a coupler 55 and a guide 57. The part of the guide 57 adjacent to the coupler 55 functions as a valve body 56. The cross-sectional area S3 of the coupler 55 is smaller than the cross-sectional area S4 of the guide 57 and the valve body 56.

The control valve 100 has a valve housing 58 containing an upper housing member 58*b* and a lower housing member 58*c*. The upper housing member 58*b* constitutes a shell for the inlet valve mechanism 51, and the lower housing member 58*c* constitutes a shell for the solenoid 52. A plug 58*a* is screwed into the upper housing member 58*b* to close an opening in its upper end. A valve chamber 59 and a through hole 60 connected thereto are defined in the upper housing member 58*b*. The upper housing member 58*b* and the plug 58*a* define a high pressure chamber 65 as a first pressure chamber. The high pressure chamber 65 and the valve chamber 59 communicate with each other through the through hole 60. The operating rod 53 extends through the valve chamber 59, the through hole 60 and the high pressure chamber 65. The operating rod 53 moves axially such that the valve body 56 selectively connects and blocks off the valve chamber 59 with respect to the through hole 60.

A first radial port 62 is formed in the upper housing member 58*b* to communicate with the valve chamber 56. The valve chamber 59 is connected to the second pressure monitoring point P2 through the first port 62 and the second pressure introduction passage 42. Thus, the pressure PdL at the second pressure monitoring point P2 exerts to the inside of the valve chamber 59 through the second pressure introduction passage 42 and the first port 62. A second port 63 extending radially is formed in the upper housing member 58*b* to communicate with the through hole 60. The through hole 60 is connected to the crank chamber 15 through the second port 63 and the crank passage 44. When the valve body 56 opens to connect the valve chamber 59 to the through hole 60, the refrigerant gas is supplied from the second pressure monitoring point P2, through the supply passage 110, which includes the second pressure introduction passage 42 and the crank passage 44, into the crank chamber 15. The ports 62 and 63, the valve chamber 59 and the through hole 60 constitute a part of the supply passage 110 within the control valve 100.

The valve body 56 is located in the valve chamber 59. The cross-sectional area S3 of the coupler 55 is less than the cross-sectional area S1 of the through hole 60. The cross-sectional area S1 of the through hole 60 is less than the cross-sectional area S4 of the valve body 56. The inner wall of the valve chamber 59, to which the through hole 60 opens, functions as a valve seat 64 for receiving the valve body 56. The through hole 60 functions as a valve opening, which is opened and closed selectively by the valve body 56. When the valve body 56 is abutted against the valve seat 64, the through hole 60 is shut off from the valve chamber 59. As shown in FIG. 3, when the valve body 56 is spaced from the valve seat 64, the through hole 60 is connected to the valve chamber 59.

The divider 54 of the operating rod 53 has a portion located in the through hole 60 and a portion located in the high pressure chamber 65. The cross-sectional area S2 of the divider 54 is equal to the cross-sectional area S1 of the through hole 60. Therefore, the divider 54 shuts off the high pressure chamber 65 from the valve chamber 59.

A third radial port 67 is defined in the upper housing member 58*b* to communicate with the high pressure chamber 65. The high pressure chamber 65 is connected through the third port 67 and the first pressure introduction passage 41 to the first pressure monitoring point P1 or the discharge chamber 23. Thus, the pressure PdH at the first pressure monitoring point P1 is exerted through the first pressure introduction passage 41 and the third port 67 to the high pressure chamber 65.

A return spring 68 is contained in the high pressure chamber 65. The return spring 68 urges the operating rod 53 to cause the valve body 56 to move away from the valve seat 64 through an aligning mechanism. The upper end of the return spring 68 is received by the plug 58*a*. The position of the plug 58*a* can be changed axially with respect to the upper housing member 58*b*. The urging force of the return spring 68 is varied depending on the axial position of the plug 58*a* with respect to the upper housing member 58*b*.

The aligning mechanism contains a spring seat 79 for receiving the return spring 68, and an aligning ball 80 located between the valve seat 79 and the divider 54. The spring seat 79 and the divider 54 each have a conical recess in which the aligning ball 80 is retained. The aligning mechanism corrects the action of the return spring 68 such that the force of the return spring 68 is applied in the axial direction. Even if the return spring 68 is tilted with respect to the axial line of the operating rod 53, only an axial force is applied to the operating rod 53. This provides smooth and accurate operation of the operating rod 53.

A first seal ring 76 is fitted on the outer surface of the lower housing member 58*c*. A second seal ring 77 and a third seal ring 78 are fitted on the outer surface of the upper housing member 58*b*. When the control valve 100 is fitted in the receiving hole 14*a* of the rear housing member 14 (see FIG. 1), the first, second and third seal rings 76, 77, 78 contact the inner circumference of the receiving hole 14*a*. The first seal ring 76 isolates the first port 62 from the outside of the compressor. The second seal ring 77 isolates the second port 63 from the first port 62. The third seal ring 78 isolates the third port 67 from the second port 63.

The solenoid 52 is provided with a cup-shaped receiving cylinder 69, which is fixed in the lower housing member 58*c*. A fixed iron core 70 is fitted in the upper opening of the receiving cylinder 69. The fixed iron core 70 constitutes a part of the inner wall of the valve chamber 59 and also defines a plunger chamber 71, which serves as a second pressure chamber. A plunger 72 is located in this plunger chamber 71. The fixed iron core 70 includes a guide hole 73, which accommodates the guide 57 of the operating rod 53. A slight clearance (not shown) exists between the inner wall of the guide hole 73 and the guide 57. The valve chamber 59 and the plunger chamber 71 communicate normally with each other through the clearance. Thus, the pressure in the valve chamber 59, or the pressure PdL at the second pressure monitoring point P2, is applied inside the plunger chamber 71.

The lower end of the guide 57 extends into the plunger chamber 71. The plunger 72 is fixed to the lower end of the guide 57. The plunger 72 moves in the axial direction integrally with the operating rod 53. A shock absorbing spring 74 is contained in the plunger chamber 71 to urge the plunger 72 toward the fixed iron core 70.

A coil 75 surrounds the fixed iron core 70 and the plunger 72. A controller 81 supplies electric power to the coil 75 through a drive circuit 82. The coil 75 then generates an electromagnetic force F between the fixed iron core 70 and the plunger 72 corresponding to the level of the electric power supplied to the coil 75. The electromagnetic force F attracts the plunger 72 toward the fixed iron core 70 and urges the operating rod 53 to cause the valve body 56 to move toward the valve seat 64.

The force of the shock absorbing spring 74 is smaller than the force of the return spring 68. Therefore, the return spring 68 moves the plunger 72 and the operating rod 53 to the initial position as shown in FIG. 3 when no power is supplied to the coil 75, and the valve body 56 is moved to the lowest position to maximize the opening size of the through hole 60.

There are methods for changing voltage applied to the coil 75, one of which is to change the voltage value and another is referred to as PWM control or duty control. Duty control is employed in this embodiment. Duty control is a method where the ON-time per cycle of a pulsed voltage, which is turned on and off periodically, is adjusted to modify the average value of the voltage applied. An average applied voltage value can be obtained by multiplying the value obtained by dividing the ON-time of the pulsed voltage by the cycle time thereof, i.e., the duty ratio Dt, by the pulsed voltage value. In duty control, the electric current varies intermittently. This reduces hysteresis of the solenoid 52. The smaller the duty ratio Dt is, the smaller the electromagnetic force F generated between the fixed iron core 70 and the plunger 72 is and the greater the opening size of the through hole 60 by the valve body 56 is. It is also possible to measure the value of the electric current flowing through the coil 75 and perform feed back control of the value of the voltage applied to the coil 75.

The opening size of the through hole 60 by the valve body 56 depends on the axial position of the operating rod 53. The axial position of the operating rod 53 is determined based on various forces that act axially on the operating rod 53. These forces will be described referring to FIGS. 3 and 4. The downward forces in FIGS. 3 and 4 tend to space the valve body 56 from the valve seat 64 (the valve opening direction). The upward forces in FIGS. 3 and 4 tend to move the valve body 56 toward the valve seat 64 (the valve closing direction).

First, the various forces acting on the portion of the operating rod 53 above the coupler 55, i.e., on the divider 54, will be described. As shown in FIGS. 3 and 4, the divider 54 receives a downward force f1 from the return spring 68. The divider 54 also receives a downward force based on the pressure PdH in the high pressure chamber 65. The effective pressure receiving area of the divider 54 with respect to the pressure PdH in the high pressure chamber 65 is equal to the cross-sectional area S2 of the divider 54. The divider 54 also receives an upward force based on the pressure in the through hole 60 (crank pressure Pc). The effective pressure receiving area of the divider 54 with respect to the pressure in the through hole 60 is equal to the cross-sectional area S2 of the divider 54 minus the cross-sectional area S3 of the coupler 55. Provided that the downward forces are positive values, the net force ΣF1 acting upon the divider 54 can be expressed by the following equation I.

$$\Sigma F1 = PdH \cdot S2 - Pc(S2 - S3) + f1 \qquad \text{Equation I}$$

Next, various forces that act upon the portion of the operating rod 53 below the coupler 55, i.e., on the guide 57, will be described. The guide 57 receives an upward force f2 from the shock absorbing spring 74 and an upward electromagnetic force F from the plunger 72. Further, as shown in FIG. 4, the end face 56*a* of the valve body 56 is divided into a radially inner portion and a radially outer portion by an imaginary cylinder, which is shown by broken lines in FIG. 4. The imaginary cylinder corresponds to the wall defining the through hole 60. The pressure receiving area of the radially inner portion is expressed by S1–S3, and that of the radially outer portion is expressed by S4–S1. The radially inner portion receives a downward force based on the pressure in the through hole 60 (crank pressure Pc). The radially outer portion receives a downward force based on the pressure PdL in the valve chamber 59.

As described above, the pressure PdL in the valve chamber 59 is applied to the plunger chamber 71. The upper surface 72*a* of the plunger 72 has a pressure receiving area that is equal to that of the lower surface 72*b* (see FIG. 3), and the forces that act on the plunger 72*b* ased on the pressure PdL offset each other. However, the lower end face 57*a* of the guide 57 receives an upward force based on the pressure PdL in the plunger chamber 71. The effective pressure receiving area of the lower end face 57*a* is equal to the cross-sectional area S4 of the guide 57. Provided that the upward forces are positive values, the net force ΣF2 acting upon the guide 57 can be expressed by the following equation II.

$$\Sigma F2 = F + f2 - Pc(S1 - S3) - PdL(S4 - S1) + PdL \cdot S4 \quad \text{Equation II}$$

$$= F + f2 + PdL \cdot S1 - Pc(S1 - S3)$$

In the process of simplifying equation II, −PdL·S4 is canceled by +PdL·S4 , and the term +PdL·S1 remains. Thus, the resultant of the downward force based on the pressure PdL acting upon the guide 57 and the upward force based on the pressure PdL acting upon the guide 57 is a net upward force, and the magnitude of this resultant force depends only on the cross-sectional area S1 of the through hole 60. The surface area of the portion of the guide 57 that receives the pressure PdL with effect, i.e., the effective pressure receiving area of the guide 57 with respect to the pressure PdL, is always equal to the cross-sectional area S1 of the through hole 60 regardless of the cross-sectional area S4 of the guide 57 and the cross-sectional area of the plunger 72.

The axial position of the operating rod 53 is determined such that the force ΣF1 in the equation I and the force ΣF2 in the equation II are equal. When the force ΣF1 is equal to the force ΣF2 (ΣF1=ΣF2), the following equation III is satisfied.

$$PdH \cdot S2 - PdL \cdot S1 - Pc(S2 - S1) = F - f1 + f2 \quad \text{Equation III}$$

The cross-sectional area S1 of the through hole 60 is equal to the cross-sectional area S2 of the divider 54. Therefore, if S2 is replaced with S1 in equation III, the following equation IV is obtained.

$$PdH - PdL = (F - f1 + f2)/S1 \quad \text{Equation IV}$$

In equation IV, f1, f2 and S1 are determined by the design of the control valve 100. The electromagnetic force F is a variable parameter that changes depending on the power supplied to the coil 75. The equation IV shows that the operating rod 53 operates to change the pressure difference (PdH−PdL) in accordance with the change in the electromagnetic force F. In other words, the operating rod 53 operates in accordance with the pressure PdH and the pressure PdL, which act on the rod 53, such that the pressure difference (PdH−PdL) seeks a target value, which is determined by the electromagnetic force F. The operating rod 53 and the plunger 72 function as a pressure detecting body or a pressure receiving body.

As described above, the downward force f1 of the return spring 68 is greater than the upward force f2 of the shock absorbing spring 74. Therefore, when no voltage is applied to the coil 75, or when the electromagnetic force F is nil, the operating rod 53 moves to the initial position shown in FIG. 3 to maximize the opening size of the through hole 60 by the valve body 56.

When the duty ratio Dt of the voltage applied to the coil 75 is the minimum value Dt(min) in a preset range, the upward electromagnetic force F exceeds the downward force f1 of the return spring 68. The upward urging force F and the upward force f2 of the shock absorbing spring 74 compete with the downward force f1 of the return spring 68 and the downward force based on the pressure difference (PdH−PdL). The operating rod 53 operates to satisfy the above equation IV to determine the position of the valve body 56 with respect to the valve seat 64. Then, refrigerant gas is supplied, from the second pressure monitoring point P2, through the supply passage 110 to the crank chamber 15 at a flow rate that depends on the valve position of the valve body 56, to adjust the crank pressure Pc.

As shown in FIGS. 2 and 3, the controller 81 is a computer, which includes a CPU, a ROM, a RAM and an input-output interface. Detectors 83 detect various external information necessary for controlling the compressor and send the information to the controller 81. The controller 81 computes an appropriate duty ratio Dt based on the information and commands the drive circuit 82 to output a voltage having the computed duty ratio Dt. The drive circuit 82 outputs the instructed pulse voltage having the duty ratio Dt to the coil 75 of the control valve 100. The electromagnetic force F of the solenoid 52 is determined according to the duty ratio Dt.

The detectors 83 may include, for example, an air conditioner switch, a passenger compartment temperature sensor, a temperature adjuster for setting a desired temperature in the passenger compartment, and a throttle sensor for detecting the opening size of a throttle valve of the engine Eg. The detectors 83 may also include a pedal position sensor for detecting the depression degree of an acceleration pedal of the vehicle. The opening size of the throttle valve and the depression degree of the acceleration pedal represent the load on the engine Eg.

Figure 5:
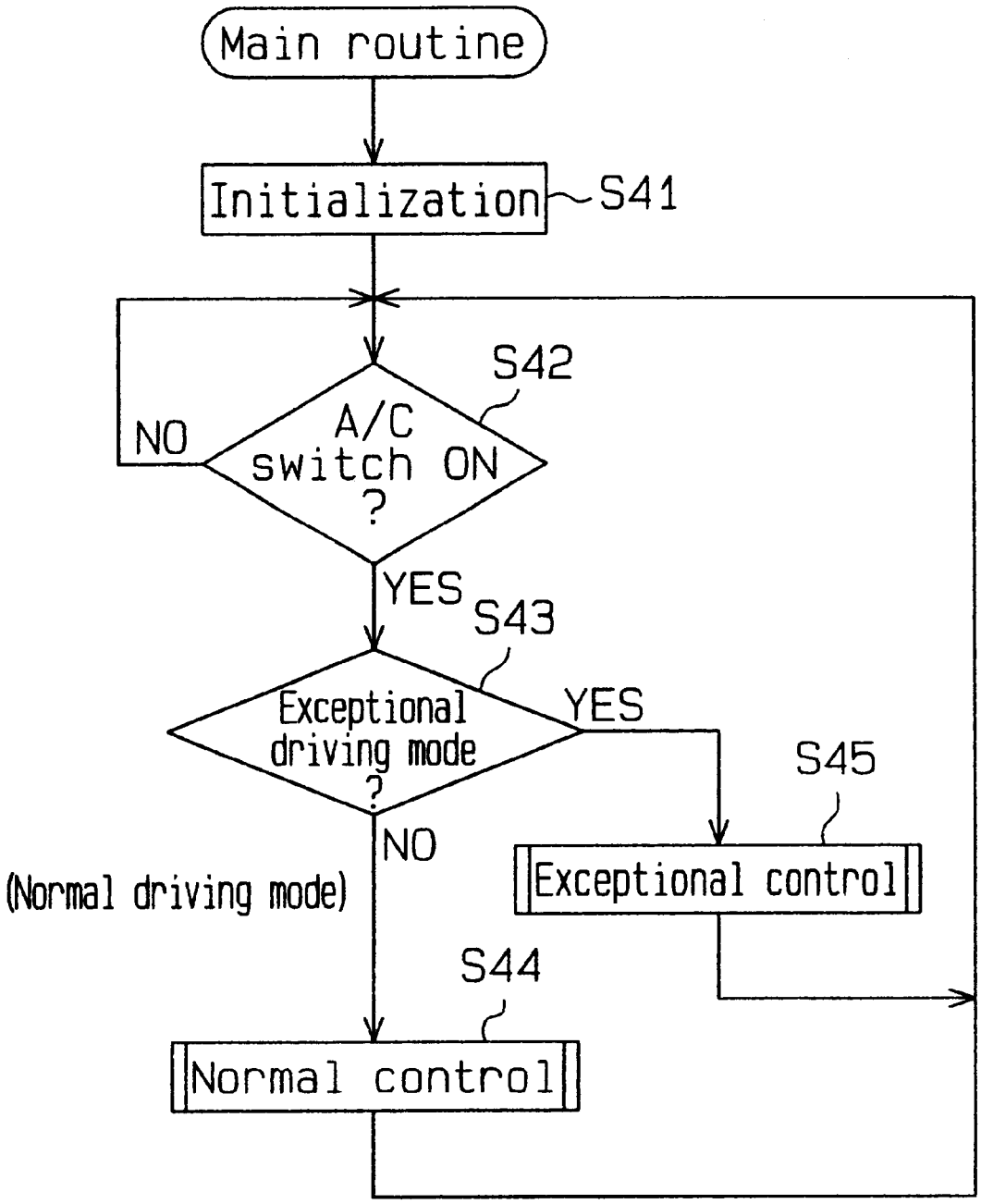
FIG. 5 is a flowchart showing a main routine for controlling a compressor displacement.

The flowchart of FIG. 5 shows the main routine for controlling the compressor displacement. When the vehicle ignition switch or the starting switch is turned on, the controller 81 starts processing. The controller 81 performs various initial setting in step S41. For example, the controller 81 assigns predetermined initial value to the duty ratio Dt of the voltage applied to the coil 75.

In step S42, the controller 81 waits until the air conditioner switch is turned on. When the air conditioner switch is turned on, the controller 81 moves to step S43. In step S43, the controller 81 judges whether the vehicle is in an exceptional driving mode. The exceptional driving mode refers to, for example, a case where the engine Eg is under high-load conditions such as when driving uphill or when accelerating rapidly. The controller 81 judges whether the vehicle is in the exceptional driving mode according to, for example, external information from the throttle sensor or the pedal position sensor.

Figure 6:
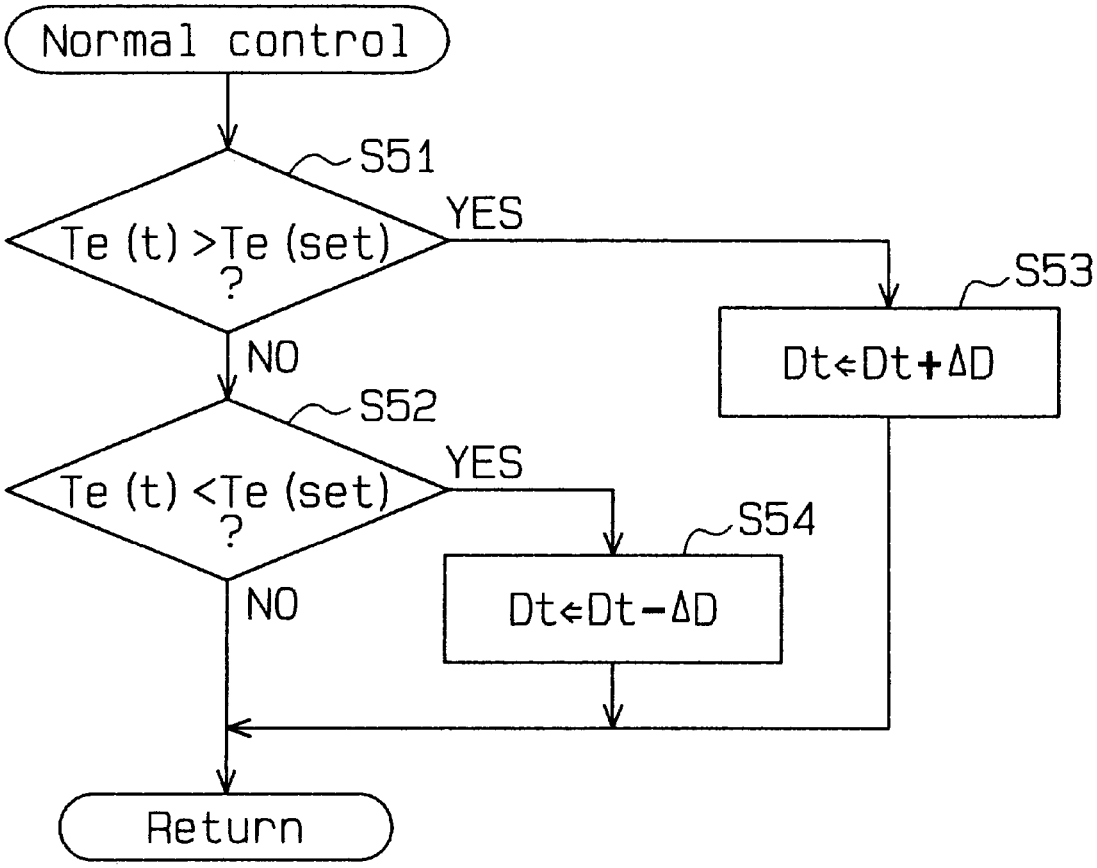
FIG. 6 is a flowchart showing a normal control procedure.
Figure 7:
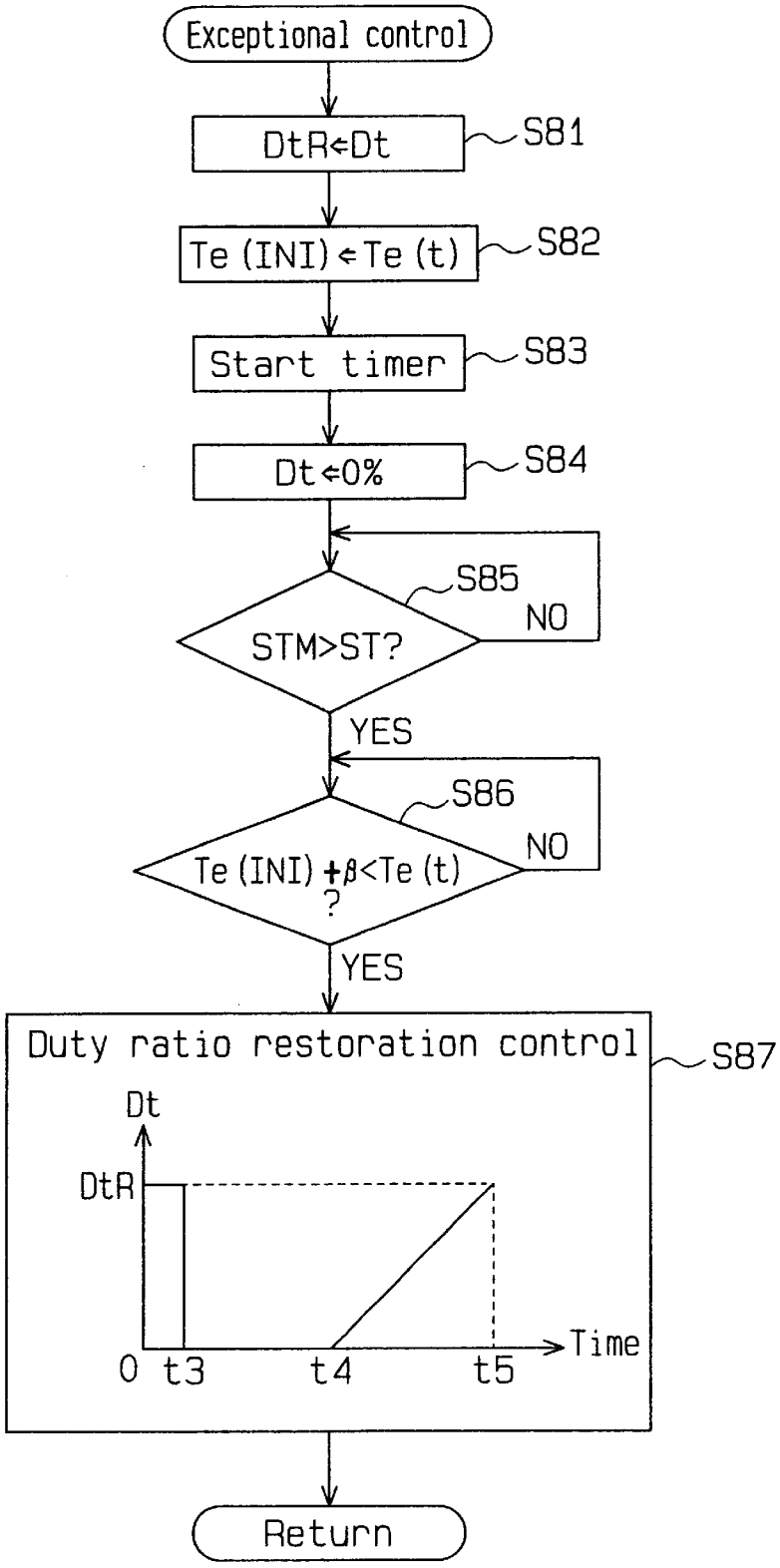
FIG. 7 is a flow chart showing an exceptional control procedure.

If the outcome of step S43 is negative, the controller 81 judges that the vehicle is in a normal driving mode and moves to step S44. The controller 81 then executes a normal control procedure shown in FIG. 6. If the outcome of step S43 is positive, the controller 81 executes an exceptional control procedure for temporarily limiting the compressor displacement in step S45. The exceptional control procedure differs according to the nature of the exceptional driving mode. FIG. 7 illustrates an example of the exceptional control procedure that is executed when the vehicle is rapidly accelerated.

The normal control procedure of FIG. 6 will now be described. In step S51, the controller 81 judges whether the temperature Te(t), which is detected by the temperature sensor, is higher than a desired temperature Te(set), which is set by the temperature adjuster. If the outcome of step S51 is negative, the controller 81 moves to step S52. In step S52, the controller 81 judges whether the temperature Te(t) is lower than the desired temperature Te(set). If the outcome in step S52 is also negative, the controller 81 judges that the detected temperature Te(t) is equal to the desired temperature Te(set) and returns to the main routine of FIG. 5 without changing the current duty ratio Dt.

If the outcome of step S51 is positive, the controller 81 moves to step S53 for increasing the cooling performance of the refrigerant circuit. In step S53, the controller 81 adds a predetermined value ΔD to the current duty ratio Dt and sets the resultant as a new duty ratio Dt. The controller 81 sends the new duty ratio Dt to the drive circuit 82. Accordingly, the electromagnetic force F of the solenoid 52 is increased by an amount that corresponds to the value ΔD, which moves the rod 53 in the valve closing direction. As the rod 53 moves, the force f1 of the return spring 68 is increased. The axial position of the rod 53 is determined such that equation IV is satisfied.

As a result, the opening size of the control valve 100 is decreased and the crank pressure Pc is lowered. Thus, the inclination angle of the swash plate 18 and the compressor displacement are increased. An increase of the compressor displacement increases the flow rate of refrigerant in the refrigerant circuit and increases the cooling performance of the evaporator 38. Accordingly, the temperature Te(t) is lowered to the desired temperature Te(set) and the pressure difference (PdH−PdL) is increased.

If the outcome of S52 is positive, the controller 81 moves to step S54 for decreasing the cooling performance of the refrigerant circuit. In step S54, the controller 81 subtracts the predetermined value ΔD from the current duty ratio Dt and sets the resultant as a new duty ratio Dt. The controller 81 sends the new duty ratio Dt to the drive circuit 82. Accordingly, the electromagnetic force F of the solenoid 52 is decreased by an amount that corresponds to the value ΔD, which moves the rod 53 in the valve opening direction. As the rod 53 moves, the force f1 of the return spring 68 is decreased. The axial position of the rod 53 is determined such that equation IV is satisfied.

As a result, the opening size of the control valve 100 is increased and the crank pressure Pc is raised. Thus, the inclination angle of the swash plate 18 and the compressor displacement are decreased. A decrease of the compressor displacement decreases the flow rate of refrigerant in the refrigerant circuit and decreases the cooling performance of the evaporator 38. Accordingly, the temperature Te(t) is raised to the desired temperature Te(set) and the pressure difference (PdH−PdL) is decreased.

As described above, the duty ratio Dt is optimized in steps S53 and S54 such that the detected temperature Te(t) seeks the desired temperature Te(set).

The exceptional control procedure of FIG. 7 will now be described. In step S81, the controller 81 stores the current duty ratio Dt as a restoration target value DtR. In step S82, the controller 81 stores the current detected temperature Te(t) as an initial temperature Te(INI), or the temperature when the displacement limiting control procedure is started.

In step S83, the controller 81 starts a timer. In step S84, the controller 81 changes the duty ratio Dt to zero percent and stops applying voltage to the coil 75. Accordingly, the opening size of the control valve 100 is maximized by the return spring 68, which increases the crank pressure Pc and minimizes the compressor displacement. As a result, the torque of the compressor is decreased, which reduces the load on the engine Eg when the vehicle is rapidly accelerated.

In step S85, the controller 81 judges whether the elapsed period STM measured by the timer is more than a predetermined period ST. Until the measured period STM surpasses the predetermined period ST, the controller 81 maintains the duty ratio Dt at zero percent. Therefore, the compressor displacement and torque are maintained at the minimum levels until the predetermined period ST elapses. The predetermined period ST starts when the displacement limiting control procedure is started. This permits the vehicle to be smoothly accelerated. Since acceleration is generally temporary, the period ST need not be long.

When the measured period STM surpasses the period ST, the controller 81 moves to step S86. In step S86, the controller 81 judges whether the current temperature Te(t) is higher than a value computed by adding a value β to the initial temperature Te(INI). If the outcome of step S86 is negative, the controller 81 judges that the compartment temperature is in an acceptable range and maintains the duty ratio Dt at zero percent. If the outcome of step S86 is positive, the controller 81 judges that the compartment temperature has increased above the acceptable range due to the displacement limiting control procedure. In this case, the controller 81 moves to step S87 and restores the cooling performance of the refrigerant circuit.

In step S87, the controller 81 executes a duty ratio restoration control procedure. In this procedure, the duty ratio Dt is gradually restored to the restoration target value DtR over a certain period. Therefore, the inclination of the swash plate 18 is changed gradually, which prevents the shock of a rapid change. In the chart of step S87, the period from time t3 to time t4 represents a period from when the duty ratio Dt is set to zero percent in step S84 to when the outcome of step S86 is judged to be positive. The duty ratio Dt is restored to the restoration target value DtR from zero percent over the period from the time t4 to time t5. When the duty ratio Dt reaches the restoration target value DtR, the controller 81 moves to the main routine shown in FIG. 5.

This embodiment has the following advantages.

The control valve 100 does not directly control the suction pressure Ps, which is influenced by the thermal load on the evaporator 38. The control valve 100 directly controls the pressure difference (PdH−PdL) between the pressures at the pressure monitoring points P1, P2 in the refrigerant circuit for controlling the compressor displacement. Therefore, the compressor displacement is controlled regardless of the thermal load on the evaporator 38. During the exceptional control procedure, no voltage is applied to the control valve 100, which quickly minimizes the compressor displacement. Accordingly, during the exceptional control procedure, the displacement is limited and the engine load is decreased. The vehicle therefore runs smoothly.

During the normal control procedure, the duty ratio Dt is adjusted based on the detected temperature Te(t) and the desired temperature Te(set), and the operating rod 53 operates depending on the pressure difference (PdH−PdL). That is, the control valve 100 not only operates based on external commands but also automatically operates in accordance with the pressure difference (PdH−PdL), which acts on the control valve 100. The control valve 100 therefore effectively controls the compressor displacement such that the actual temperature Te(t) seeks the target temperature Te(set) and maintains the target temperature Te(set) in a stable manner. Further, the control valve 200 quickly changes the compressor displacement when necessary.

The duty ratio Dt of the voltage applied to the solenoid 52, i.e., the electromagnetic force F of the solenoid 52, indicates the desired value of the pressure difference (PdH−PdL). The operating rod 53 operates according to the pressure difference (PdH−PdL) so that the pressure difference (PdH−PdL) is steered to the desired value. Thus, the intended displacement control is constantly and reliably realized. For example, when the compressor is operating at the minimum displacement in the exceptional control procedure, the compressor can easily return to a normal displacement according to a desired recovery pattern, and such a recovery pattern is easily set to avoid shocks that may occur due to the displacement increase.

The second pressure introduction passage 42 for connecting the second pressure monitoring point P2 to the control valve 100 functions as a part of the supply passage 110. Therefore, the second pressure introduction passage 42 need not be formed separately from the supply passage 110. This simplifies the compressor and the control valve 110. That is, the number of passages formed in the compressor is minimized. Also, the number of ports formed in the control valve 100 and the number of seal rings used in the control valve 100 are minimized.

The operating rod 53 integrally includes the divider 54, the coupler 55 and the guide 57 in a single body, and a part of the guide 57 forms the valve body 56. This reduces the number of parts and simplifies the control valve 100.

The pressure acting on the operating rod 53 includes the pressure PdH at the first pressure monitoring point P1, the pressure PdL at the second pressure monitoring point and the crank pressure Pc. However, as can be understood from the above equation IV, the force based on the crank pressure Pc has substantially no effect on the operating rod 53. This is mainly because the cross-sectional area S1 of the through hole 60, more specifically, the cross-sectional area S1 of the portion of the through hole 60 opening to the valve chamber 59, is the same as the cross-sectional area S2 of the divider 54. Therefore, the gas pressures determining the axial position of the operating rod 53 are only the pressure PdH at the first pressure monitoring point P1 and the pressure PdL at the second pressure monitoring point P2. This allows the operating rod 53 to operate smoothly depending on the pressure difference (PdH−PdL) under no and not the crank pressure Pc, thus producing a highly accurate displacement control valve.

The diameter of the through hole 60 is constant in the axial direction and is equal to the diameter of the divider 54. Thus, in assembling the control valve 100, the operating rod 53 as an integral body and can be inserted easily into the through hole 60 from the valve chamber 59 side.

It should be apparent to those skilled in the art that the present invention may be embodied in many other specific forms without departing from the spirit or scope of the invention. Particularly, it should be understood that the invention may be embodied in the following forms.

Figure 8:
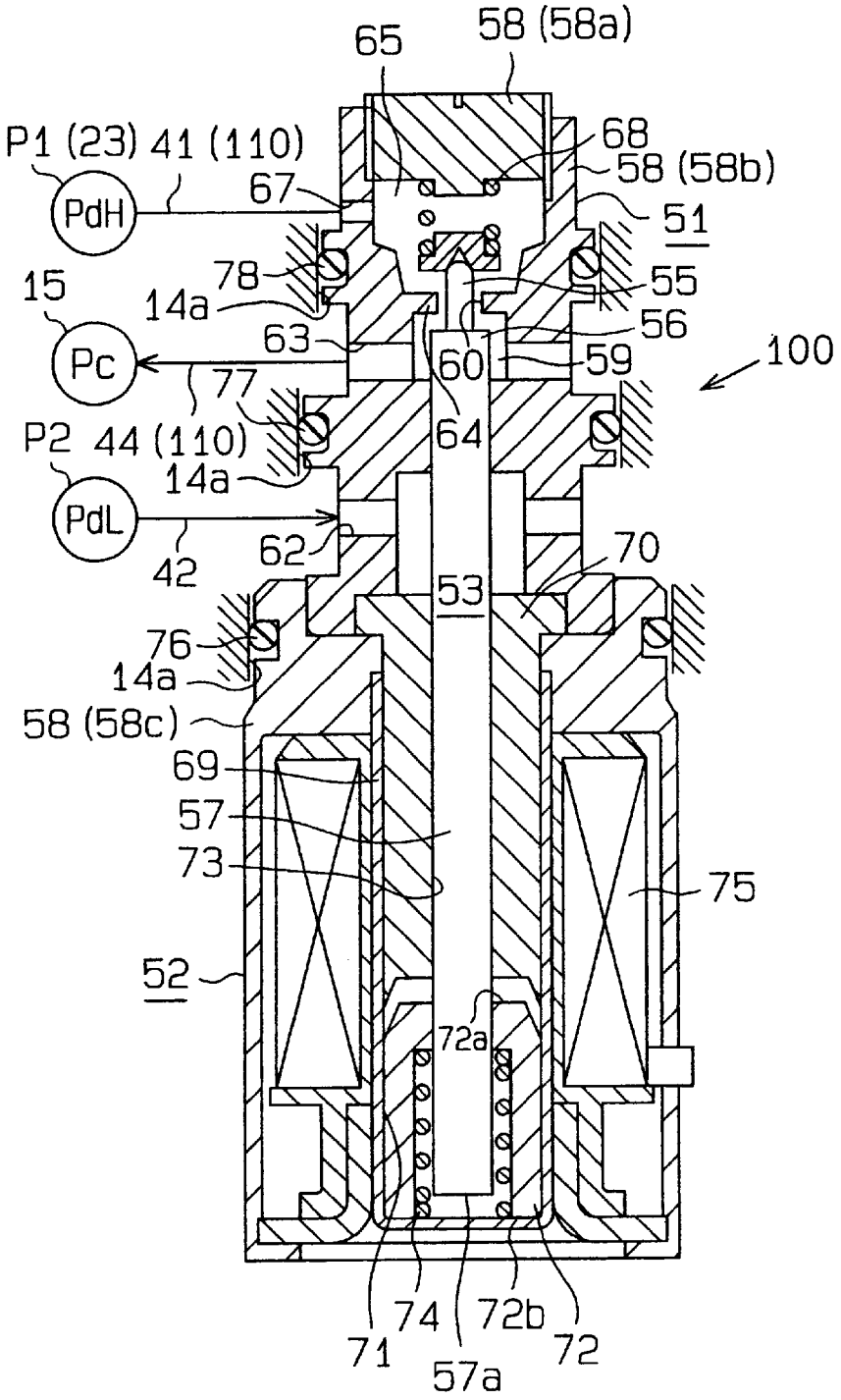
FIG. 8 is a cross-sectional view illustrating a control valve according to a second embodiment of the present invention.
Figure 9:
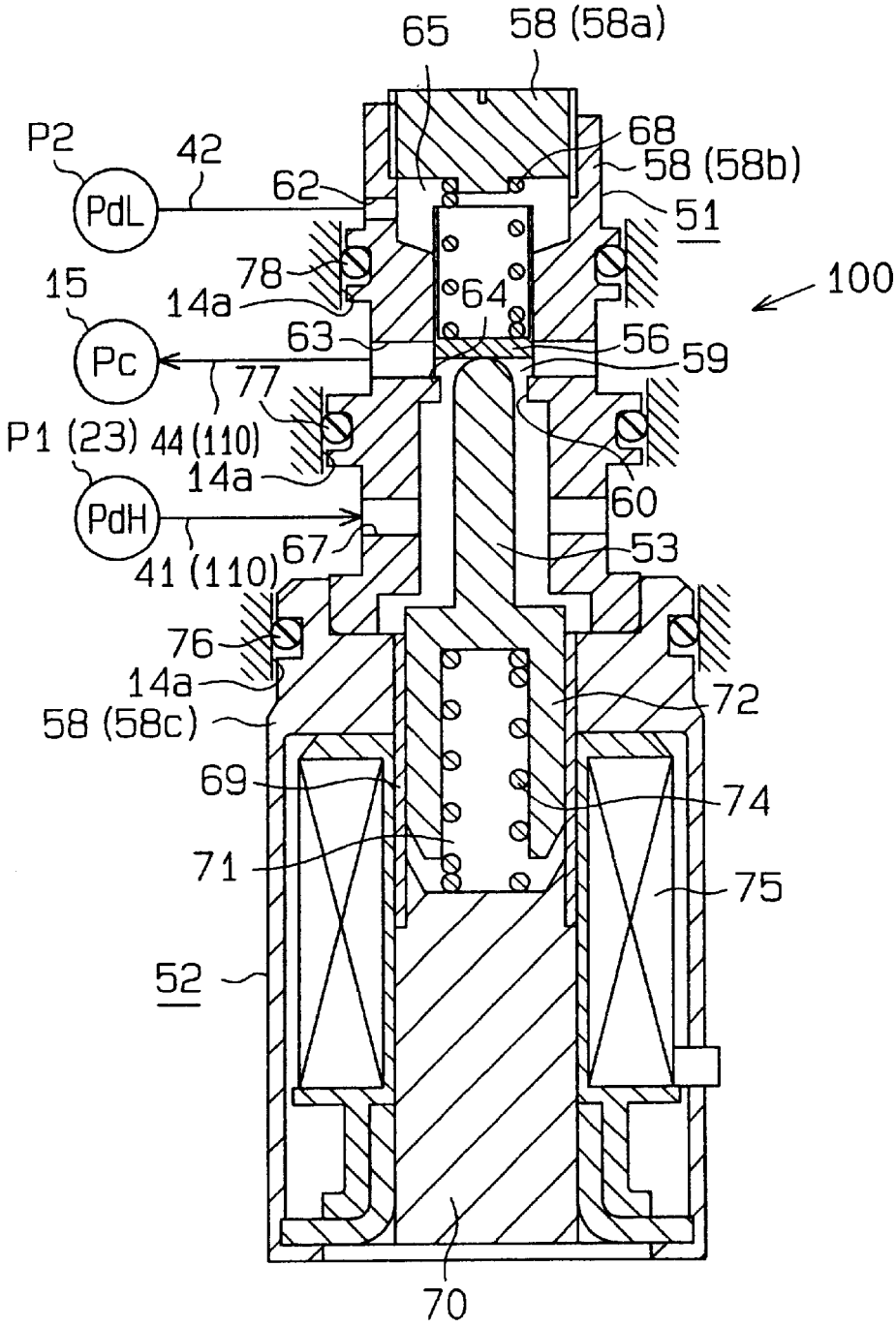
FIG. 9 is a cross-sectional view illustrating a control valve according to a third embodiment of the present invention.

FIG. 8 shows a control valve 100 according to a second embodiment of the present invention. FIG. 9 shows a control valve 100 according to a third embodiment of the present invention. In each of these control valves 100, the supply passage 110 is defined by the first pressure introduction passage 41 and the crank passage 44. Accordingly, the internal constructions of the control valves 100 are changed somewhat, as shown in FIGS. 8 and 9, respectively, compared with the control valve 100 shown in FIG. 3. The same or like components have the same reference numbers in all embodiments.

Since the control valve of FIG. 8 is basically the same as that of the control valve 100 of FIG. 3, further description of it will be omitted.

In the control valve 100 of FIG. 9, a clearance (not shown) is defined between the plunger 72 and the receiving cylinder 69. This clearance permits application of the pressure PdH to the plunger chamber 71.

Further, in the control valve of FIG. 9, the positional relationship between the plunger 72 and the fixed iron core 70 is reversed compared with the control valves 100 in FIGS. 3 and 8. The valve body 56 is not integrated with the operating rod 3 but is independent. However, the electromagnetic force of the solenoid 52 acts against the operating rod 53 in the valve closing direction like in the control valves shown in FIGS. 3 and 8.

Unlike the control valves 100 shown in FIGS. 3 and 8, the force of the return spring 68 is weaker than the force of the shock absorbing spring 74. When no voltage is applied to the coil 75, the shock absorbing spring 74 moves the plunger 72 and the operating rod 53 in the valve opening direction. Thus, the valve body 56 opens the through hole 60 fully, as shown in FIG. 9. The electromagnetic force generated between the plunger 72 and the fixed iron core 70, when a voltage is applied to the coil 75, moves the operating rod 53 in the valve closing direction. Since the return spring 68 presses the valve body 56 against the operating rod 53, the valve body 56 moves integrally with the operating rod 53.

Figure 10:
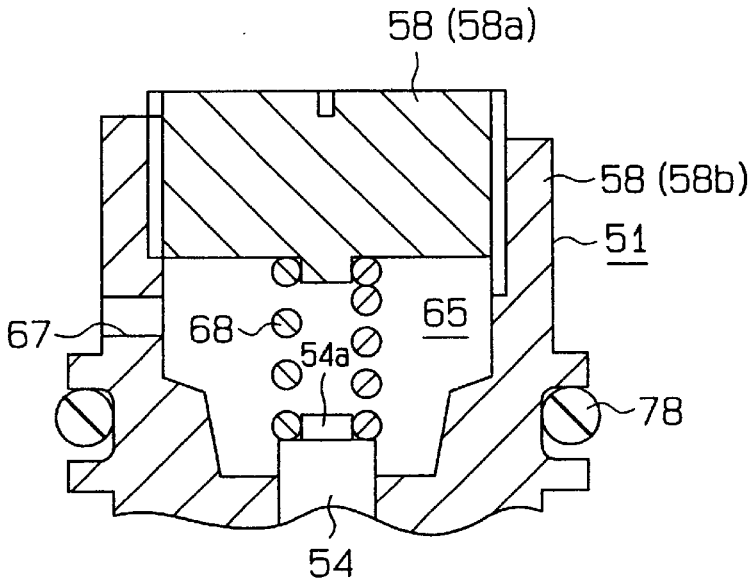
FIG. 10 is a cross-sectional view showing part of a control valve according to a fourth embodiment of the present invention.
Figure 11:
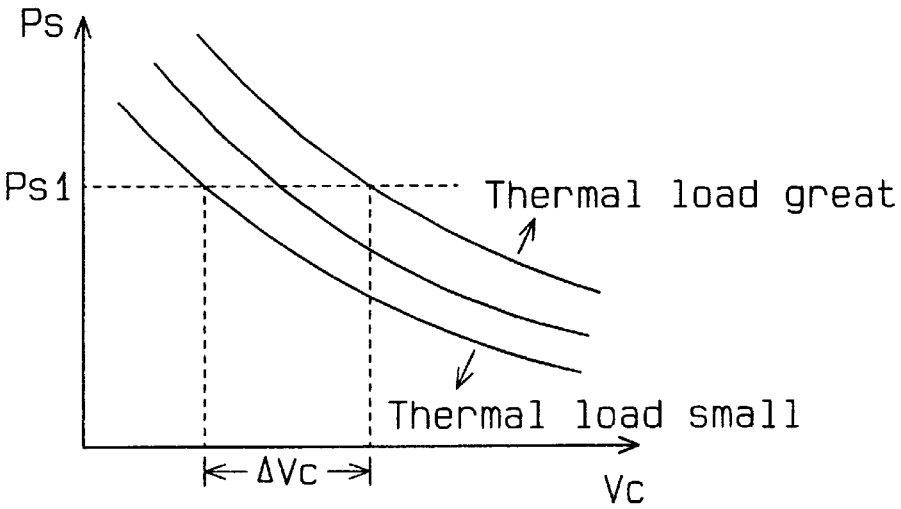
Fig.11 (Prior Art)
FIG. 11 is a graph showing the relationship between the suction pressure Ps and the displacement Vc of a prior art compressor.

In a fourth embodiment shown in FIG. 10, the aligning mechanism including the spring seat 79 and the aligning ball 80 of the control valve 100 shown in FIG. 3 is omitted. The return spring 68 is directly abutted against the divider 54 of the operating rod 53. The divider 54 has at the upper end a boss 54*a* for receiving the return spring 68.

In the control valve 100 of FIG. 3, the cross-sectional area S1 of the portion of the through hole 60 opening to the valve chamber 59 may be smaller than the cross-sectional area S2 of the divider 54. The merits of such a control valve 100 will be described. The following equation V is a modification of the above equation III. In equation V, S1 is smaller than S2.

$$(PdH-Pc)S2-(PdL-Pc)S1=F-f1+f2 \qquad \text{Equation V}$$

When equation IV is rearranged so that the right side in equation IV is equal to that of equation V, the following equation VI is obtained.

$$(PdH-PdL)S1=F-f1+f2 \qquad \text{Equation VI}$$

When the left side in equation V is compared with that in equation VI, under the condition of PdH>PdL>Pc, the following relationship is established.

$$(PdH-Pc)S2-(PdL-Pc)S1>(PdH-PdL)S1$$

Thus, when the control valve 100 satisfies the condition S2>S1, the force based on the pressure difference (PdH−PdL) that acts on the operating rod 53 is greater than that when S2=S1. Therefore, when S2>S1, even if the flow rate of the refrigerant in the refrigerant circuit is relatively low, i.e., even if the pressure difference (PdH−PdL) is relatively small, the pressure difference (PdH−PdL) reliably determines the position of the operating rod 53.

The control valve 100 may be designed to adjust the aperture size of the bleed passage 31 in addition to that of the supply passage 110.

The first pressure monitoring point P1 need not be located in the discharge chamber 23. The first pressure monitoring point P1 may be located at any position as long as the position is exposed to the discharge pressure Pd. In other words, the first pressure monitoring point P1 may be located anywhere in a high pressure zone of the refrigerant circuit, which includes the discharge chamber 23, the condenser 36 and the higher pressure pipe 40. The second pressure monitoring point P2 may be located at any position that is downstream of the first pressure monitoring point P1 in the high pressure zone.

The present invention can be embodied in a control valve of a wobble type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A control valve for a variable displacement compressor used in a refrigerant circuit, wherein the refrigerant circuit includes a condenser and a high pressure passage extending from a discharge chamber of the compressor to the condenser, wherein a section of the refrigerant circuit that includes the discharge chamber, the condenser and the high pressure passage forms a high pressure zone, and wherein the control valve controls the pressure in a crank chamber of the compressor to change the displacement of the compressor, the control valve comprising:

a valve housing, wherein the valve housing is located in a supply passage, which connects the high pressure zone to the crank chamber, wherein the supply passage includes an upstream section, which is between the high pressure zone and the valve housing, and a downstream section, which is between the valve housing and the crank chamber;

a first pressure chamber defined in the valve housing, the first pressure chamber being exposed to the pressure of a first pressure monitoring point, which is located in the high pressure zone;

a second pressure chamber defined in the valve housing, the second pressure chamber being exposed to the pressure of a second pressure monitoring point, which is located in a part of the high pressure zone that is downstream of the first pressure monitoring point, wherein the upstream section of the supply passage connects the first pressure chamber or the second pressure chamber to the corresponding pressure monitoring point;

a valve body located in the valve housing, wherein the valve body adjusts the opening size of the supply passage; and a pressure receiving body located in the valve housing, wherein the pressure receiving body moves the valve body in accordance with the difference between the pressure in the first pressure chamber and the pressure in the second pressure chamber.

2. The control valve according to claim 1, wherein the pressure receiving body is a rod, which moves axially, and wherein the rod has an end face that receives the pressure of the first pressure chamber and another end face that receives the pressure in the second pressure chamber.

3. The control valve according to claim 2, wherein the valve body is integral with the rod.

4. The control valve according to claim 1, wherein a valve chamber for accommodating the valve body and a through hole for communicating the valve chamber with the first pressure chamber are defined in the valve housing, wherein the pressure receiving body includes a divider and a coupler, wherein the divider is located in the through hole to disconnect the valve chamber from the first pressure chamber and the coupler couples the divider with the valve body, and wherein the cross-sectional area of the coupler is less than the cross-sectional area of the through hole.

5. The control valve according to claim 4, wherein the cross-sectional area of the divider is equal to the cross-sectional area of a section of the through hole that opens to the valve chamber.

6. The control valve according to claim 1, further comprising an actuator for urging the valve body by a force, the magnitude of which corresponds to an external signal, wherein the urging force of the actuator represents the target value of the pressure difference, and wherein the pressure receiving body moves the valve body such that the pressure difference seeks the target value.

7. The control valve according to claim 6, wherein the actuator urges the valve body in a direction opposite to the direction of the force applied to the pressure receiving body based on the pressure difference.

8. The control valve according to claim 6, wherein the actuator is a solenoid that generates an electromagnetic force, the magnitude of which corresponds to the magnitude of a supplied current, wherein the control valve includes an urging member that urges the valve body in a direction opposite to the direction in which the solenoid urges the valve body, and wherein, when electric current is not supplied to the solenoid, the urging member causes the valve body to maximize the opening size of the supply passage.

9. The control valve according to claim 6, wherein the actuator includes a plunger chamber and a plunger accommodated in the plunger chamber, the plunger chamber functioning as either the first pressure chamber or the second pressure chamber, wherein the pressure receiving body is a rod, which moves axially, and wherein the rod includes an end that extends into the plunger chamber and is fixed to the plunger.

10. The control valve according to claim 9, wherein the end of the rod that is fixed to the plunger is a first end, and wherein the rod includes a second end that extends into the pressure chamber other than the plunger chamber.

11. A displacement control mechanism for a variable displacement compressor used in a refrigerant circuit, wherein the refrigerant circuit includes a condenser and a high pressure passage extending from a discharge chamber of the compressor to the condenser, wherein a section of the refrigerant circuit that includes the discharge chamber, the condenser and the high pressure passage forms a high pressure zone, and wherein the displacement control mechanism controls the pressure in a crank chamber of the compressor to change the displacement of the compressor, the displacement control mechanism comprising:

a supply passage, wherein the supply passage connects the high pressure zone to the crank chamber to conduct gas from the high pressure zone to the crank chamber;

a control valve located in the supply passage, wherein the control valve includes a first pressure chamber and a second pressure chamber, and wherein the supply passage includes an upstream section, which is between the high pressure zone and the control valve, and a downstream section, which is between the control valve and the crank chamber;

a first introduction passage for connecting a first pressure monitoring point, which is located in the high pressure zone, with the first pressure chamber;

a second introduction passage for connecting a second pressure monitoring point, which is located in a part of the high pressure zone that is downstream of the first pressure monitoring point, with the second pressure chamber, wherein either the first introduction passage or the second introduction passage functions as the upstream section of the supply passage;

a valve body located in the control valve, wherein the valve body adjusts the opening size of the supply passage; and a pressure receiving body located in the control valve, wherein the pressure receiving body moves the valve body in accordance with the difference between the pressure in the first pressure chamber and the pressure in the second pressure chamber.

12. The displacement control mechanism according to claim 11, wherein the control valve includes a valve chamber for accommodating the valve body and a through hole for communicating the valve chamber with the first pressure chamber, wherein the pressure receiving body includes a divider and a coupler, wherein the divider is located in the through hole to disconnect the valve chamber from the first pressure chamber and the coupler couples the divider with the valve body, and wherein the cross-sectional area of the coupler is less than the cross-sectional area of the through hole.

13. The displacement control mechanism according to claim 12, wherein the cross-sectional area of the divider is equal to the cross-sectional area of a section of the through hole that opens to the valve chamber.

14. The displacement control mechanism according to claim 11, wherein the control valve further comprises an actuator for urging the valve body by a force, the magnitude of which corresponds to an external signal, wherein the urging force of the actuator represents the target value of the pressure difference, and wherein the pressure receiving body moves the valve body such that the pressure difference seeks the target value.

15. The displacement control mechanism according to claim 14, wherein the actuator urges the valve body in a direction opposite to the direction of the force applied to the pressure receiving body based on the pressure difference.

16. The displacement control mechanism according to claim 14, wherein the actuator is a solenoid that generates an electromagnetic force, the magnitude of which corresponds to the magnitude of a supplied current, wherein the control valve includes an urging member that urges the valve body in a direction opposite to the direction in which the solenoid urges the valve body, and wherein, when electric current is not supplied to the solenoid, the urging member causes the valve body to maximize the opening size of the supply passage.

17. The displacement control mechanism according to claim 14, wherein the actuator includes a plunger chamber and a plunger accommodated in the plunger chamber, the plunger chamber functioning as either the first pressure chamber or the second pressure chamber, wherein the pressure receiving body is a rod, which moves axially, and wherein the rod includes an end that extends into the plunger chamber and is fixed to the plunger.

18. The displacement control mechanism according to claim 17, wherein the end of the rod that is fixed to the plunger is a first end, and wherein the rod includes a second end that extends into the pressure chamber other than the plunger chamber.

19. The displacement control mechanism according to claim 11, wherein a fixed restrictor is located in the high pressure passage between the first pressure monitoring point and the second pressure monitoring point.

* * * * *

UNITED STATES PATENT AND TRADEMARK OFFICE

CERTIFICATE OF CORRECTION

PATENT NO. : 6,382,926 B2
DATED : May 7, 2002
INVENTOR(S) : Ota et al.

It is certified that error appears in the above-identified patent and that said Letters Patent is hereby corrected as shown below:

Title page,
Item [56], References Cited, U.S. PATENT DOCUMENTS, Patent No. 6,048,178, please delete "5/2001 Ota et al." and insert therefor -- 4/2000 Kawaguchi et al. --

Column 8,
Line 64, please delete "plunger 72*b* ased" and insert therefor -- plunger 72 based --

Signed and Sealed this

Seventeenth Day of September, 2002

*Attest:*

*Attesting Officer*

JAMES E. ROGAN
*Director of the United States Patent and Trademark Office*